US011033095B1

(12) United States Patent
VanHeusen

(10) Patent No.: US 11,033,095 B1
(45) Date of Patent: Jun. 15, 2021

(54) ADJUSTABLE POUCH

(71) Applicant: Wilder Tactical, LLC, Gastonia, NC (US)

(72) Inventor: Joshua VanHeusen, Gastonia, NC (US)

(73) Assignee: Wilder Tactical, LLC, Gastonia, NC (US)

( * ) Notice: Subject to any disclaimer, the term of this patent is extended or adjusted under 35 U.S.C. 154(b) by 0 days.

(21) Appl. No.: 16/903,543

(22) Filed: Jun. 17, 2020

(51) Int. Cl.
*A45F 5/00* (2006.01)
*F42B 39/02* (2006.01)
*A45C 3/00* (2006.01)

(52) U.S. Cl.
CPC ..... *A45F 5/00* (2013.01); *A45C 3/001* (2013.01); *A45F 2200/0508* (2013.01); *A45F 2200/0591* (2013.01); *F42B 39/02* (2013.01)

(58) Field of Classification Search
CPC .... A45F 2005/1013; A45F 5/02; A45F 5/021; A45F 5/00; A45F 2200/0516; A45F 2200/0591; A45C 13/1046; A45C 13/30; Y10S 224/901
USPC ..... 224/250
See application file for complete search history.

(56) References Cited

U.S. PATENT DOCUMENTS 5,622,346 A * 4/1997 Story, Jr. ..... A45F 5/02 224/148.6
9,394,080 B2 7/2016 Beck
9,668,568 B2 6/2017 Evans
9,759,536 B2 * 9/2017 Gadams ..... B65D 25/20
9,795,210 B2 10/2017 Evans
9,861,184 B2 * 1/2018 VanHeusen ..... F41C 33/0209
10,352,652 B2 * 7/2019 Higdon, Jr. ..... F41C 33/0236
10,835,005 B2 * 11/2020 Buerck ..... A45C 7/0059
10,928,172 B1 * 2/2021 Mironski ..... F42B 39/02
2008/0277436 A1 11/2008 Wilson
2016/0058127 A1 * 3/2016 Burns ..... F41C 33/0209 36/58.5
2019/0365064 A1 12/2019 Buerck

FOREIGN PATENT DOCUMENTS

CN 201040061 Y 3/2008
CN 204956535 U 1/2016

* cited by examiner

*Primary Examiner* — Adam J Waggenspack
(74) *Attorney, Agent, or Firm* — Kim and Lahey Law Firm, LLC; Seannn P. Lahey

(57) ABSTRACT

An adjustable pouch comprising a nonrigid inner sheet folded in a generally U-shaped arrangement defining a front side and a rear side connected by a bottom portion; a nonrigid outer sheet secured around an outer surface of said inner sheet; a plurality of strap receiving channels extending between said inner sheet and said outer sheet on said rear side; a plurality of non-elastic nonrigid straps extending outward from a perimeter edge of said outer sheet on said front side, wherein said straps are received in said strap receiving channels; a binding cord interconnecting a distal end portion of each said strap between said inner sheet and said outer sheet; a first sidewall insert carried by said straps on a first side; and, a second sidewall insert carried by said straps on a second side opposite said first side.

20 Claims, 5 Drawing Sheets

ADJUSTABLE POUCH

BACKGROUND OF THE INVENTION

1) Field of the Invention

The present invention relates to adjustable pouches, and more particularly, to an adjustable pouch made primarily of nonrigid material with a retention system that is adapted to releasably secure a variety of items for quick access.

2) Description of Related Art

Adjustable pouches are often used as tactical gear for holding items such as magazines, radios, handcuffs, tourniquets and the like, which are typically used to provide quick access to items while attempting to securely hold the items. The adjustable pouches in the prior art typically use an elastic binding cord to interconnect front and rear portions of a pouch. While this provides adjustability and conformability, depending on the pouch material, the elastic binding cord extending along the sides between the front and rear portions allows for too much flex and causes items to flop around in the pouch, which can lead to the items falling out.

Additionally, the top opening of the pouch is often not adapted to quickly inserting an item. As such, items can get hung-up on the edges of the opening when being inserted. Also, some pouch designs allow for gaps along the sidewalls, which allow items to catch on the binding cord when being inserted or removed.

Accordingly, it is an object of the present invention to provide a pouch that eliminates the flop associated with elastic binding cords while having a retention system that is adjustable to releasably secure items for quick access.

It is a further object of the present invention to provide and adjustable pouch adapted for rapidly inserting items and removing items.

It is a further object of the present invention to provide and adjustable pouch that is scalable up or down to fit a wide variety of items.

SUMMARY OF THE INVENTION

The above objectives are accomplished according to the present invention by providing an adjustable pouch comprising a nonrigid inner sheet folded in a generally U-shaped arrangement defining an inner front section connected to an inner rear section by an inner bottom portion, and defining an open top portion between the inner front section and the inner rear section; wherein the inner front section includes a front outer surface and a front inner surface opposite the front outer surface; and wherein the inner rear section includes a rear inner surface spaced apart from and facing the front inner surface, and a rear outer surface opposite the rear inner surface; a nonrigid outer sheet having a complementary shape to the inner sheet and folded in a generally U-shaped arrangement defining an outer front section connected to an outer rear section by an outer bottom portion; wherein the outer front section includes a front exterior surface and a front interior surface opposite the front exterior surface; and wherein the outer rear section includes a rear exterior surface, and a rear interior surface opposite the rear exterior surface; the outer sheet is disposed on the inner sheet so that the front interior surface of the outer sheet is disposed adjacent the front outer surface of the inner sheet, and the rear interior surface of the outer sheet is disposed adjacent the rear outer surface of the inner sheet; a plurality of strap receiving channels extending horizontally between the rear outer surface of the inner sheet and the rear interior surface of the outer sheet, wherein the strap receiving channels are defined by stitching lines extending at least partially across the outer rear section and bonding the outer sheet to the inner sheet; a plurality of non-elastic nonrigid straps extending horizontally outward from a perimeter edge of the outer front section of the outer sheet, wherein the plurality of straps include at least two straps extending from a first perimeter edge of the outer sheet and at least two straps extending from a second perimeter edge of the outer sheet opposite the first perimeter edge, and wherein the plurality of straps are received into the strap receiving channels from opposing perimeter edges of the outer rear section and the inner rear section; a strap loop defined by a looped distal end portion on each of the straps; a vertical cord channel extending perpendicularly through the plurality of strap receiving channels along a generally central portion between the rear outer surface of the inner sheet and the rear interior surface of the outer sheet; a binding cord extending through the strap loop of each the strap and through the vertical cord channel between the rear outer surface of the inner sheet and the rear interior surface of the outer sheet; and, a cord exit port disposed in the outer bottom portion of the outer sheet through which the binding cord exits for operation by a user; whereby drawing and loosening the binding cord causes the straps to move laterally through the strap receiving channels to expand and contract the distance between the front inner surface and rear inner surface.

In a further advantageous embodiment, a hook and loop connector material is disposed on the front inner surface and the rear inner surface of the inner sheet.

In a further advantageous embodiment, a first feed ramp is included having a complementary portion of hook and loop connector material engaging the hook and loop connector material disposed on the front inner surface, and a second feed ramp is included having a complementary portion of hook and loop connector material engaging the hook and loop connector material disposed on the rear inner surface.

In a further advantageous embodiment, the first and second feed ramps each include an angled end portion extending outwardly from the open top portion between the inner front section and the inner rear section.

In a further advantageous embodiment, a pair of guide notches are disposed in the strap loop on each of the straps, wherein the guide notches receive the binding cord.

In a further advantageous embodiment, a first sidewall insert is disposed along a first perimeter edge gap between the inner front section and the inner rear section, and a second sidewall insert is disposed along a second perimeter edge gap opposite the first perimeter edge gap between the inner front section and the inner rear section.

In a further advantageous embodiment, a plurality of sidewall strap channels are provided, wherein each of the straps extends through one of the sidewall strap channels for carrying the first and second sidewall inserts between the inner front section and the inner rear section.

In a further advantageous embodiment, the first and second sidewall inserts include an angled lip portion extending outwardly from the open top portion.

In a further advantageous embodiment, a plurality of molle slots are formed in the front exterior surface of the outer sheet.

In a further advantageous embodiment, the molle slots extend horizontally across the front exterior surface of the outer sheet, wherein the outer front section of the outer sheet is secured to the inner front section of the inner sheet to define two front channels extending vertically between the front interior surface of the outer sheet and the front outer surface of the inner sheet, and wherein the molle slots are arranged to define a first column of vertically spaced molle slots disposed along a first of the front channels and a second column of vertically spaced molle slots disposed along a second of the front channels.

In a further advantageous embodiment, a plurality of molle slots are formed in the rear exterior surface of the outer sheet.

In a further advantageous embodiment, the molle slots on the rear exterior surface are arranged in a vertical spaced column along the vertical cord channel.

In a further advantageous embodiment, the binding cord is arranged in a crisscross pattern extending between the strap loops.

In a further advantageous embodiment, the binding cord includes a top loop portion extending outward from openings defined between the inner sheet and the outer sheet by stitching lines along a top edge portion of the inner sheet and the outer sheet so that the top loop portion is adjacent the open top portion.

In a further advantageous embodiment, a slide lock is disposed on the binding cord, wherein the slide lock is adjustable along a length of the binding cord that has exited the cord exit port to control movement of the binding cord through the strap loops.

The above objectives are accomplished according to the present invention by providing an adjustable pouch comprising a nonrigid inner sheet folded in a generally U-shaped arrangement defining a front side and a rear side connected by a bottom portion; a nonrigid outer sheet secured around an outer surface of the inner sheet; a plurality of strap receiving channels extending between the inner sheet and the outer sheet on the rear side; a plurality of non-elastic nonrigid straps extending horizontally outward from a perimeter edge of the outer front section of the outer sheet, wherein the plurality of straps include at least two straps extending from a first perimeter edge of the outer sheet and at least two straps extending from a second perimeter edge of the outer sheet opposite the first perimeter edge, and wherein the plurality of straps comprise elongated generally rectangular arms vertically spaced along the first and second perimeter edges of the outer sheet, and wherein the plurality of straps are received into the strap receiving channels; a strap loop included on a distal end portion of each of the straps; and, a binding cord extending through the strap loop of each the strap between the inner sheet and the outer sheet.

In a further advantageous embodiment, a vertical cord channel extends perpendicularly through the plurality of strap receiving channels along a generally central portion between the inner sheet and the outer sheet on the rear side, wherein the binding cord extends through the strap loops in a crisscross arrangement along the vertical cord channel.

In a further advantageous embodiment, a cord exit port is disposed in the outer sheet through which the binding cord exits; a slide lock disposed on the binding cord, wherein the slide lock is adjustable along a length of the binding cord that has exited the cord exit port to control movement of the binding cord through the strap loops.

In a further advantageous embodiment, a first sidewall insert is carried by the straps on a first side, and a second sidewall insert is carried by the straps on a second side opposite the first side.

In a further advantageous embodiment, a first feed ramp is carried by the inner sheet on the front side, and a second feed ramp is carried by the inner sheet on the rear side.

The above objectives are accomplished according to the present invention by providing an adjustable pouch comprising a nonrigid inner sheet folded in a generally U-shaped arrangement defining a front side and a rear side connected by a bottom portion; a nonrigid outer sheet secured around an outer surface of the inner sheet; a plurality of strap receiving channels extending between the inner sheet and the outer sheet on the rear side; a plurality of non-elastic nonrigid straps extending outward from a perimeter edge of the outer sheet on the front side, wherein the straps are received in the strap receiving channels; a binding cord interconnecting a distal end portion of each the strap between the inner sheet and the outer sheet; a first sidewall insert carried by the straps on a first side; and, a second sidewall insert carried by the straps on a second side opposite the first side.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1A:
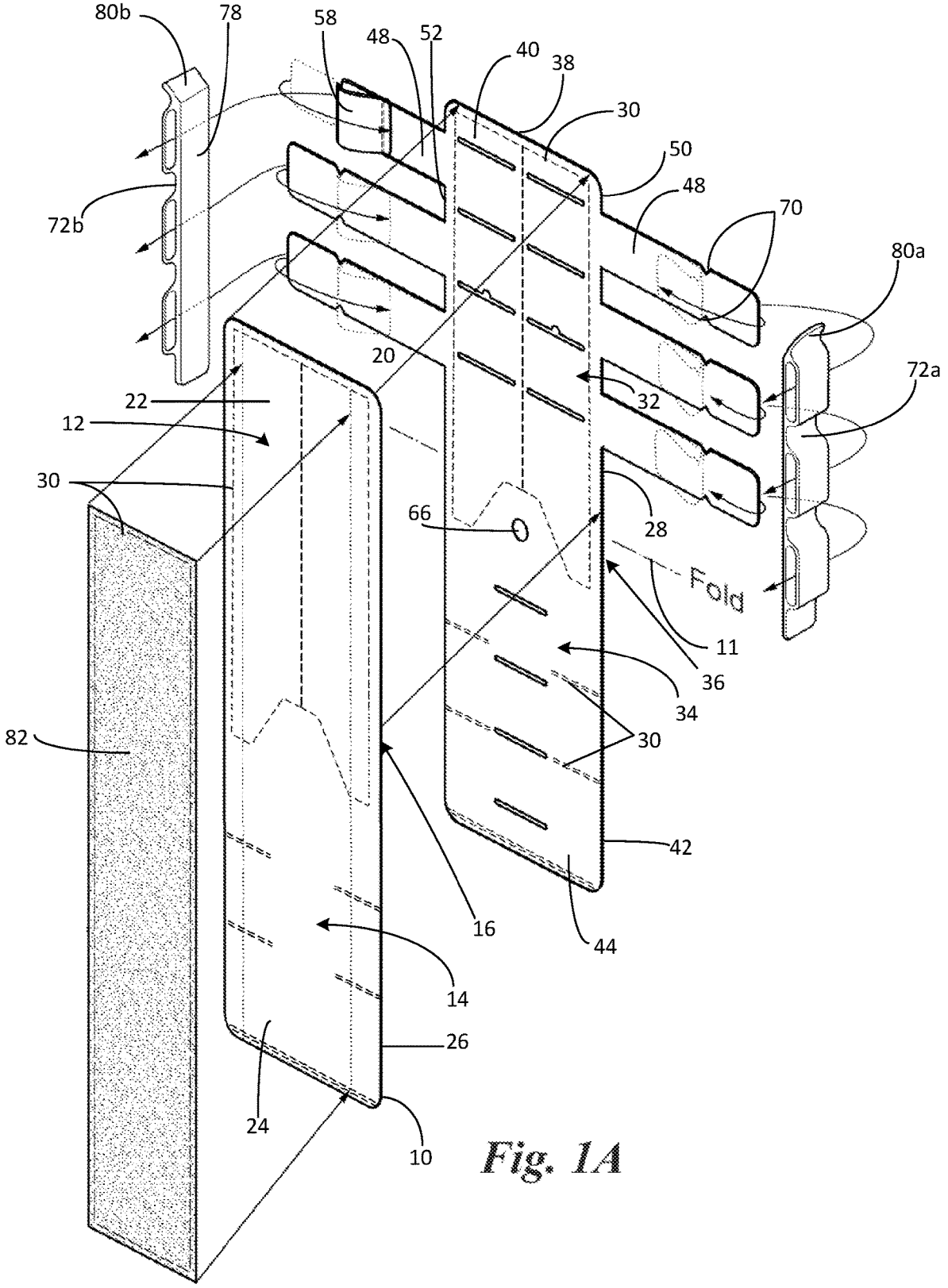
FIG. 1A shows an exploded perspective view of the adjustable pouch according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 1B:
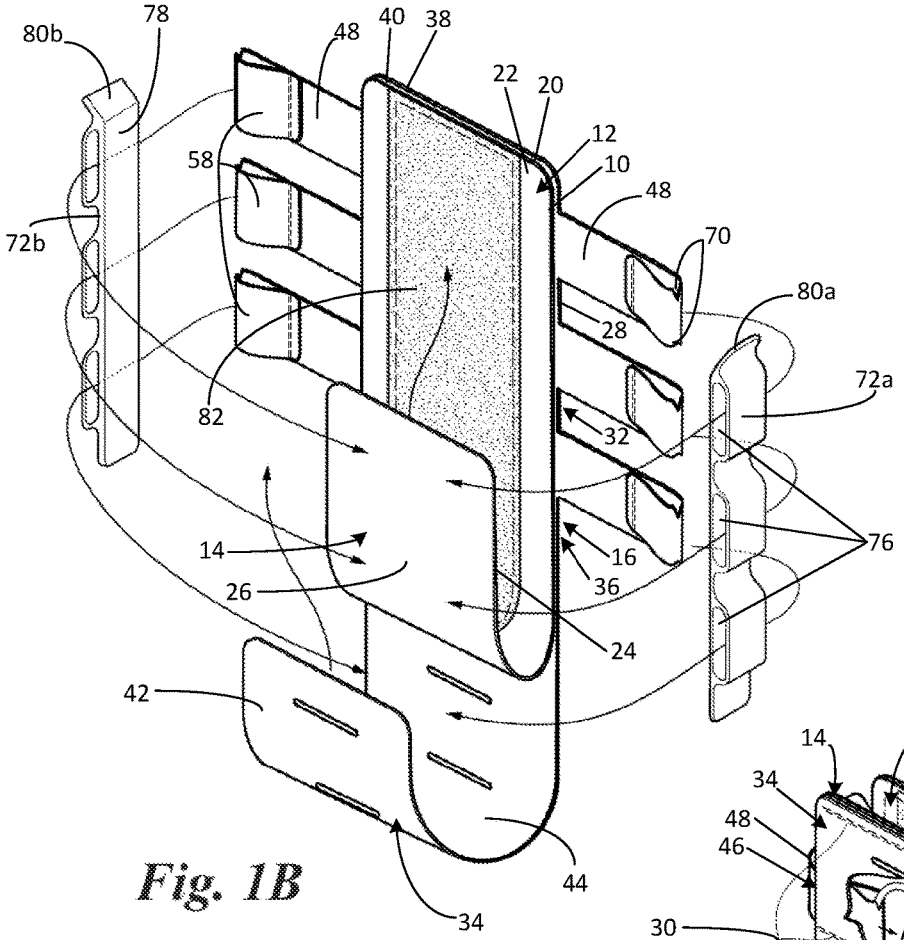
FIG. 1B shows a partially exploded perspective view of the adjustable pouch according to the present invention.
Figure 1C:
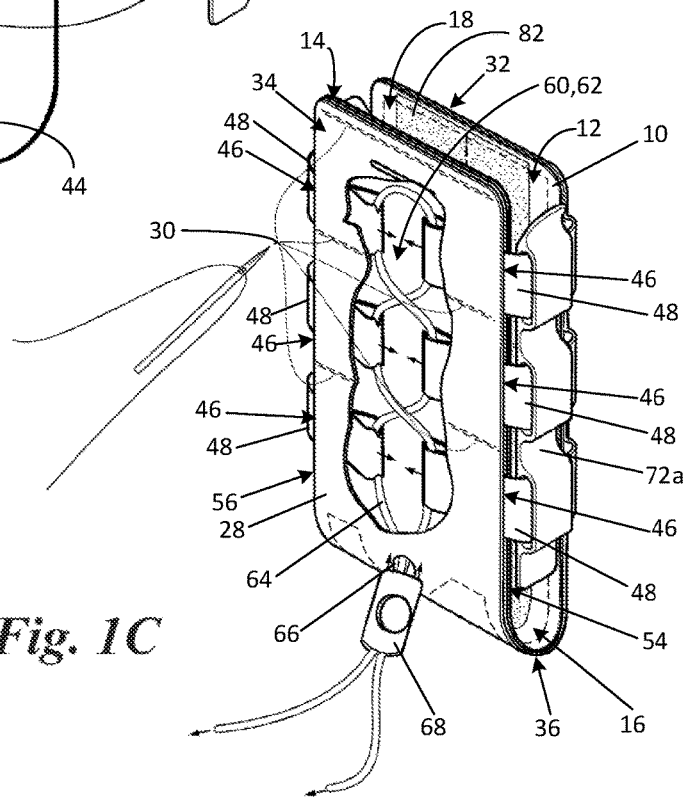
FIG. 1C shows a cut-away view of a rear side of the adjustable pouch according to the present invention.

Referring to FIGS. 1A, 1B, and 1C, the illustrated embodiment of the adjustable pouch according to the present invention includes a nonrigid inner sheet 10. Inner sheet 10 has a generally rectangular shape in the example embodiment which is advantageous for defining a pouch able to accommodate a wide variety of items. However, inner sheet 10 may comprise various shapes to accommodate various intended items for the pouch to carry. For example, inner sheet 10 may alternatively have a generally square shape. Inner sheet 10 is preferably made from a fabric or other flexible woven or non-woven material.

Inner sheet 10 is folded along fold line 11 in a generally U-shaped arrangement to form a pouch for receiving items. In the U-shaped arrangement (FIGS. 1B and 1C), inner sheet 10 includes an inner front section 12 connected to an inner rear section 14 by an inner bottom portion 16. An open top portion 18 (best shown in FIG. 1C) is defined between inner front section 12 and inner rear section 14. Further, inner front section 12 includes a front outer surface 20 and a front inner surface 22 opposite front outer surface 20. Also, inner rear section 14 includes a rear inner surface 24 spaced apart from and facing front inner surface 22, and a rear outer surface 26 opposite rear inner surface 24. Accordingly, items are placed in the pouch through the open top portion 18 and between front inner surface 22 and rear inner surface 24 of inner sheet 10.

Referring to FIGS. 1A, 1B, and 1C, the illustrated embodiment of the adjustable pouch according to the present invention includes a nonrigid outer sheet 28 having a complementary shape to inner sheet 10. Thus, outer sheet 28 has a generally rectangular shape in the example embodiment for overlapping inner sheet 10. Outer sheet 28 may be made from a fabric or other flexible woven or non-woven material that is the same as or different from inner sheet 10. For example, a more durable outer sheet 28, such as a water resistant canvas fabric or the like, can be provided while a more gripping material, such as a rubber sheet or fabric containing a gripping element, can be provided for inner sheet 10. Further examples of acceptable materials for inner sheet 10 and outer sheet 28 include, but are not limited to, laminated fabrics and urethane coated fabrics such as those with the tradenames Ballon™, Squadron™, HST™, Poly Duck™, Tough Duck™, and Blast™.

Outer sheet 28 is folded along fold line 11 in a generally U-shaped arrangement overtop of inner sheet 10. In the illustrated embodiment, outer sheet 28 is secured to inner sheet 10 by stitching the two sheets together along various stitching lines 30. Alternative attachment means may also be employed such as, for example, sonic welding, rivets, pins, fasteners, zippers, clips, buckles, buttons, adhesives, and the like. In the U-shaped arrangement (FIGS. 1B and 1C), outer sheet 28 includes an outer front section 32 connected to an outer rear section 34 by an outer bottom portion 36. Further, outer front section 32 includes a front exterior surface 38 and a front interior surface 40 opposite front exterior surface 38. Also, outer rear section 34 includes a rear exterior surface 42, and a rear interior surface 44 opposite rear exterior surface 42.

In the illustrated embodiment, when folded and secured together, outer sheet 28 is disposed on inner sheet 10 so that front interior surface 40 of outer sheet 28 is disposed adjacent to front outer surface 20 of inner sheet 10, and rear interior surface 44 of outer sheet 28 is disposed adjacent to rear outer surface 26 of inner sheet 10. Accordingly, outer sheet 28 covers over inner sheet 10 in a layered arrangement.

In the illustrated embodiment, a plurality of strap receiving channels 46 are defined between rear outer surface 26 of inner sheet 10 and rear interior surface 44 of outer sheet 28. The strap receiving channels 46 are defined by stitching lines 30 extend horizontally across at least a portion outer rear section 34 and bonding outer sheet 28 to inner sheet 10. Accordingly, the strap receiving channels 46 extending horizontally across between the outer rear section 34 and inner rear section 14.

In the illustrated embodiment, a plurality of non-elastic nonrigid straps 48 extend horizontally outward from a perimeter edge of outer front section 32 of outer sheet 28. Preferably, the plurality of straps 48 include at least two straps extending from a first perimeter edge 50 of outer sheet 28, and at least two straps extending from a second perimeter edge 52 of outer sheet 28 opposite first perimeter edge 50. In the example embodiment, the plurality of straps 48 comprise elongated generally rectangular arms that are vertically spaced along the first and second perimeter edges 50, 52 of outer sheet 28. Further, each strap 48 includes a strap loop 58 defined by a looped distal end portion that is stitched back onto the length of the strap 48 to form the loop.

The plurality of straps 48 are received into strap receiving channels 46 from opposing perimeter edges 54, 56 of outer rear section 34 and inner rear section 14. The straps 48 are disposed in strap receiving channels 46 so that strap loops 58 are carried in or adjacent to a centrally located vertical cord channel 60. In the illustrated embodiment, vertical cord channel 60 extends perpendicularly through the plurality of horizontally arranged strap receiving channels 46 along a generally central portion between rear outer surface 26 of inner sheet 10 and rear interior surface 44 of outer sheet 28. Vertical cord channel 60 is generally define by a gap between stitching lines 30 that define the plurality of strap receiving channels 46 along a central portion 62 between rear outer surface 26 of inner sheet 10 and rear interior surface 44 of outer sheet 28.

In the illustrated embodiment, a binding cord 64 extending through the strap loop 58 of each strap 48. The binding cord 64 is generally disposed in an extends along vertical cord channel 60 between rear outer surface 26 of inner sheet 10 and rear interior surface 44 of outer sheet 28. Accordingly, binding cord 64 is concealed and protected between the inner and outer sheets 10, 28. In one embodiment, binding cord 64 is a shock cord, bungee cord, rubber cord or other elastic cord or band. While other non-elastic cords can be used, an elastic binding cord is preferred to allow for straps 48 to have a biasing force drawing each strap 48 into strap receiving channels 46 when the pouch is carrying an item. Preferably, binding cord 64 is arranged in a crisscross pattern extending between strap loops 58. The crisscross pattern helps to resist excess stretching of binding cord 64 and unwanted movement of straps 48. Additionally, as shown in FIGS. 1A, 1B and 1C, a pair of guide notches 70 are disposed on opposite top and bottom sides in strap loop 58 on each of straps 48. The guide notches 70 receive and control the location binding cord 64 passing through each of strap loops 58.

When the non-stretchable material of straps 48 is wrapped around a corner it takes part of the load and creates a friction point. Straps 48 can wrap around the corner of an item in the pouch, as well as engage the material of the inner and outer sheets 10, 28 in the strap receiving channels 46. More particularly, straps 48 engage perimeter edges 54, 56 of outer rear section 34 and inner rear section 14. This eliminates the flop or stretching on the sides associated with using an elastic binding cord to connect the front and rear portions of the pouch together. The binding cord 64 can still do the job of allowing the straps to extend and retract from strap receiving channels 46, but they are not subject to the forces generated when, for example, running with a full pouch that cause flopping of items in the pouch. Accordingly, the arrangement of the present invention allows for expansion of the pouch when you put something in it, but stops excess stretching that causes the item to flop about in the pouch when straps 48 are placed under load.

In the example embodiment, a cord exit port 66 is disposed in the outer bottom portion 36 of outer sheet 28 through which binding cord 64 exits for operation by a user. Further, a slide lock 68 is disposed on binding cord 64. Slide lock 68 is adjustable along a length of binding cord 64 that has exited cord exit port 66 to control movement of binding cord 64 through said strap loops 58. By drawing binding cord 64 out of cord exit port 66 the strap loops 58 of each of straps 48 are drawn closer together, and by loosening binding cord 64 to allow more of binding cord 64 into vertical cord channel 60, strap loops 58 of straps 48 can extend farther apart. Thus, drawing and loosening binding cord 64 causes straps 48 to move laterally through strap receiving channels 46. This in turn allows straps 48 to expand and contract the distance between front inner surface 22 and rear inner surface 24.

Referring to FIGS. 1A-1C, 2 and 3, in the illustrated embodiment, a first sidewall insert 72*a* is disposed along a first perimeter edge gap 74A (FIGS. 2, 3) between inner front section 12 and inner rear section 14. A second sidewall insert 72*b* is disposed along a second perimeter edge gap 74*b* opposite first perimeter edge gap 74*a* between inner front section 12 and inner rear section 14. Sidewall inserts 72*a*, 72*b* are preferably a rigid material such as a molded or printed plastic material, but may alternatively be a non-rigid material such as the material selected for inner and outer sheets 10, 28. Each of sidewall inserts 72*a*, 72*b* include a plurality of sidewall strap channels 76, wherein each of straps 48 extends through one of sidewall strap channels 76 for carrying first and second sidewall inserts 72*a*, 72*b* between inner front section 12 and inner rear section 14. Each of sidewall inserts 72*a*, 72*b* stabilize straps 48 and allow items to slide in and out of the pouch with less chance of snagging by providing a flat uniform engaging surface 78 (best shown in FIGS. 1A and 1B) on each sidewall of the pouch. Each of sidewall inserts 72*a*, 72*b* is free floating on straps 48 so that the sidewall inserts can expand out as much as needed with straps 48 to accommodate items being inserted into the pouch.

Figure 2:
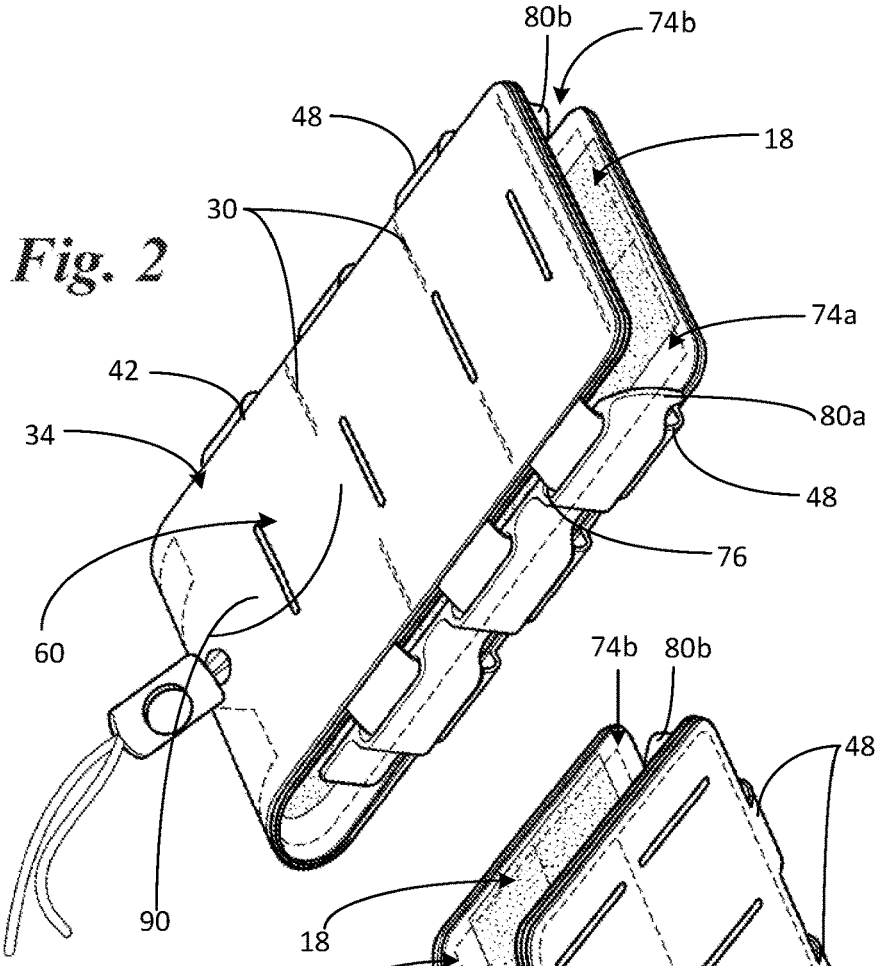
FIG. 2 shows a rear side perspective view of the adjustable pouch according to the present invention.
Figure 3:
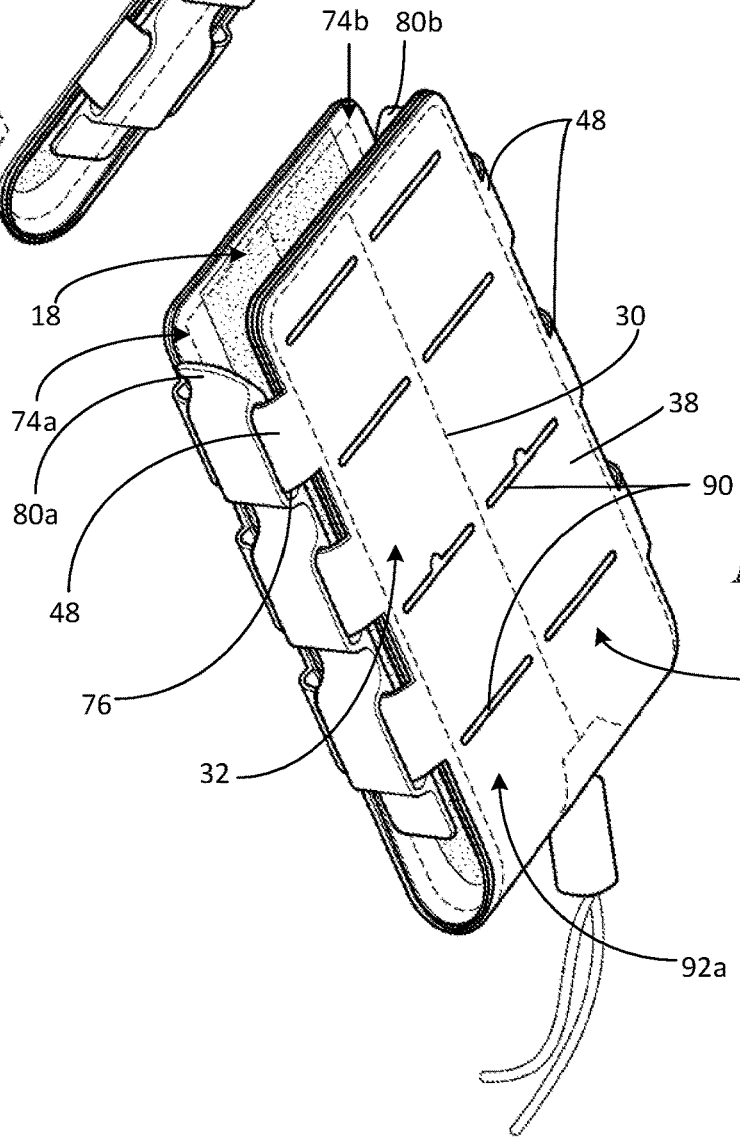
FIG. 3 shows a front side perspective view of the adjustable pouch according to the present invention.

Referring to FIGS. 1A and 1B, first and second sidewall inserts 72*a*, 72*b* preferably include an angled lip portion 80*a* and 80*b*, respectively. With further reference to FIGS. 2 and 3, angled lip portions 80*a* and 80*b* extend outwardly from open top portion 18 to facilitate the insertion of items into the pouch.

Referring to FIGS. 1A-1C, a sheet of hook and loop connector material 82 or the like, for example Velcro®, is disposed on front inner surface 22 and rear inner surface 24 of inner sheet 10. The sheet of hook and loop connector material 82 provides the ability to put a variety of inserts in open top portion 18 and lining front inner surface 22 and rear inner surface 24 of inner sheet 10. Example inserts include, but are not limited to, items such as feed ramps to help guide items into open top portion 18, or rubber patches to help grip items carried in the pouch.

Figure 4A:
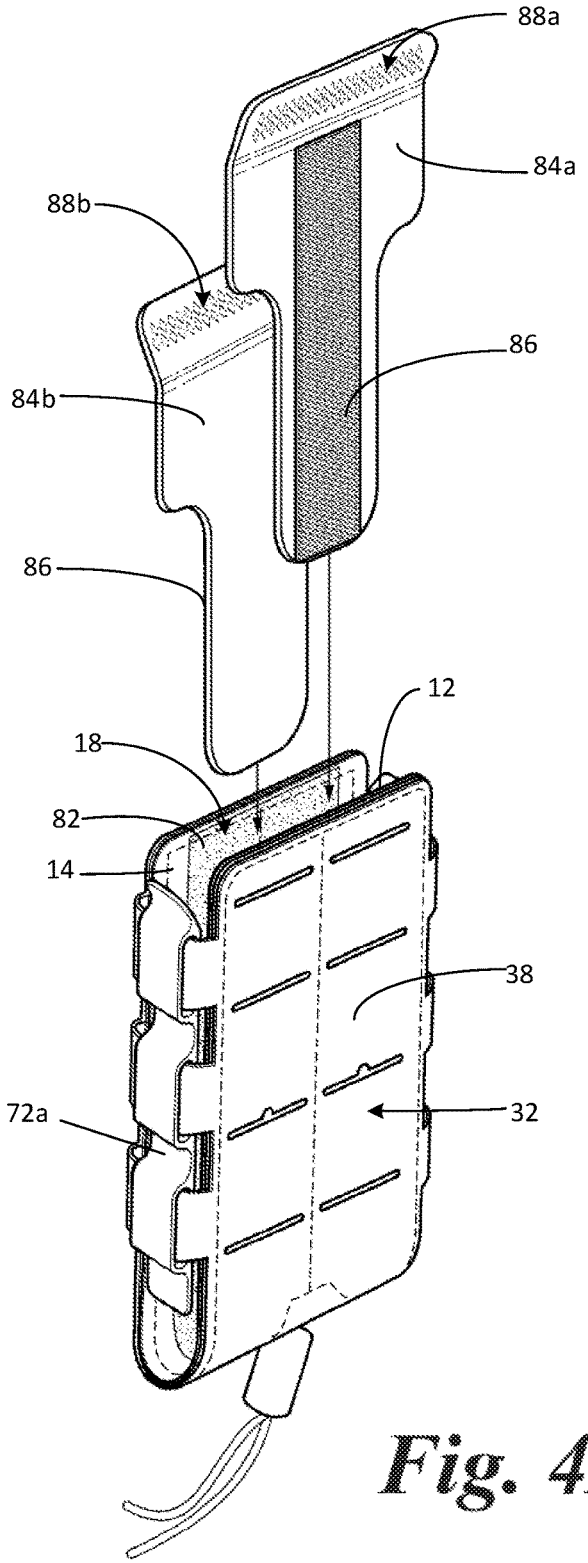
FIG. 4A shows a partially exploded perspective view of feed ramps used in the adjustable pouch according to the present invention.
Figure 4B:
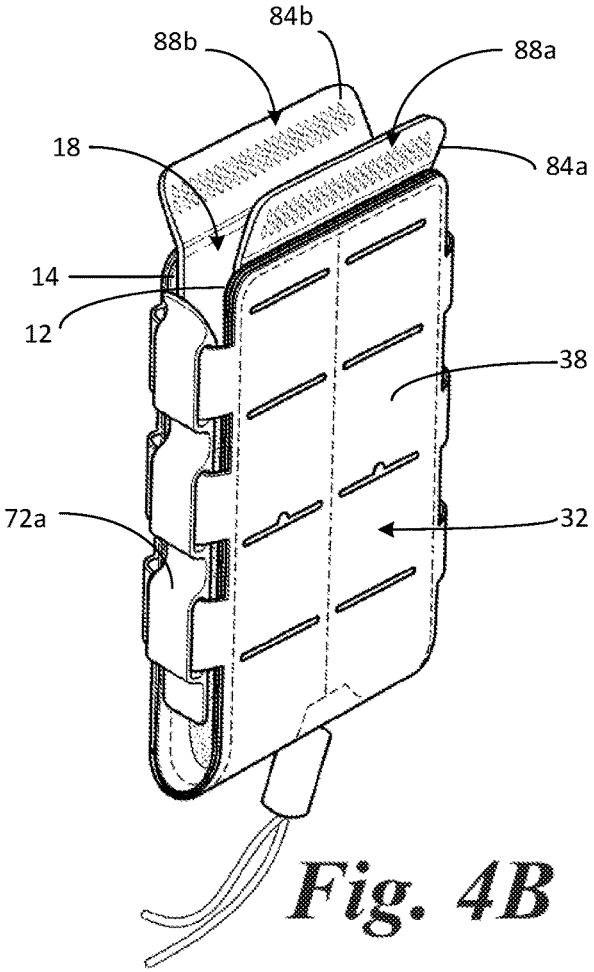
FIG. 4B shows a front side perspective view of feed ramps used in the adjustable pouch according to the present invention; and, FIG. 5 shows a cut-away view of a rear side of the adjustable pouch with an exposed top loop portion of the binding cord according to the present invention.

Referring to FIGS. 4A and 4B, in the illustrated embodiment, the pouch includes a first feed ramp 84*a* having a complementary portion of hook and loop connector material 86 engaging hook and loop connector material 82 disposed on front inner surface 22. A second feed ramp 84*b* is also provided having a complementary portion of hook and loop connector material 86 engaging hook and loop connector material 82 disposed on rear inner surface 24. First and second feed ramps 84*a* and 84*b* each include an angled end portion 88*a* and 88*b* extending outwardly from open top portion 18 between inner front section 12 and inner rear section 14.

Referring to FIG. 3, in the illustrated embodiment, a plurality of molle slots 90 are formed in front exterior surface 38 of outer sheet 28. Preferably, molle slots 90 extend horizontally across front exterior surface 38 of outer sheet 28. In the illustrated arrangement, outer front section 32 of outer sheet 28 is secured to inner front section 12 of inner sheet 10 to define two front channels 92*a* and 92*b* extending vertically between front interior surface 40 of outer sheet 28 and front outer surface 20 of inner sheet 10. Front channels 92*a* and 92*b* are formed by stitching inner sheet 10 and outer sheet 28 together along stitch lines 30 as illustrated. Molle slots 90 are arranged to define a first column of vertically spaced molle slots 90 disposed along a first of front channels 92*a* and a second column of vertically spaced molle slots 90 disposed along a second of front channels 92*b*.

Referring to FIG. 2, in the illustrated embodiment, a plurality of molle slots 90 are formed in rear exterior surface 42 of outer sheet 28. Preferably, molle slots 90 extend horizontally across rear exterior surface 42 of outer sheet 28. Molle slots 90 on rear exterior surface 42 are arranged in a vertical spaced column extending complementary with and along vertical cord channel 60 between stitch lines 30 that extend partially across rear exterior surface 42 for binding outer sheet 28 to inner sheet 10.

Figure 5:
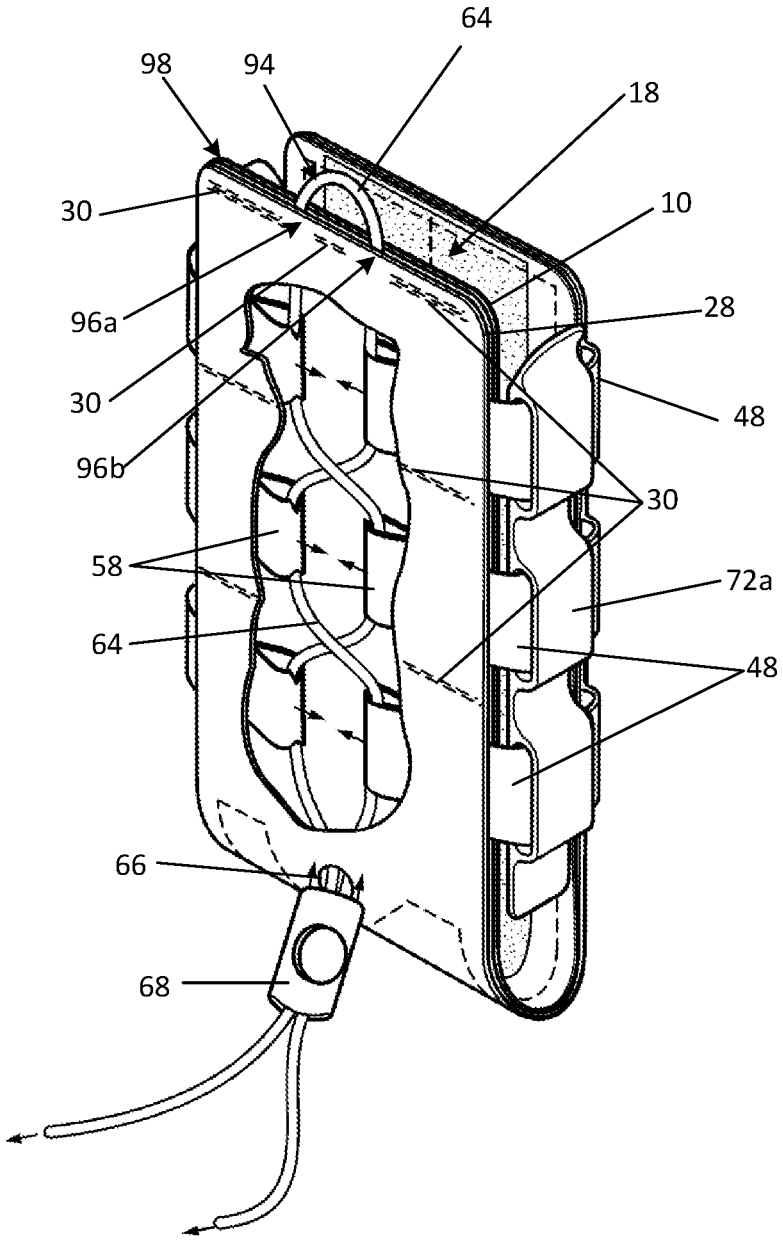

Referring to FIG. 5, in the illustrated embodiment, binding cord 64 includes a top loop portion 94 extending outward from openings 96*a* and 96*b* defined between the inner sheet 10 and the outer sheet 28 by stitching lines 30 along a top edge portion 98 of inner sheet 10 and outer sheet 28 so that the top loop portion 94 is adjacent the open top portion 18. The exposed top loop portion 94 allows for better alignment and adjustability of the nonrigid straps 48 adjacent, particularly the top two straps adjacent the top edge portion 98. For example, when adjusting straps 48, binding cord 64 can first be raised by pulling on top loop portion 94, which provides increased flexibility for allowing movement of straps 48 to accommodate an item being placed in the pouch. Once the adjustments to straps 48 are made to accommodate the item to be carried in the pouch, binding cord 64 can then be drawn out cord exit port 66, which retracts top loop portion 94 against top edge portion 98 of inner and outer sheets 10, 28. The slide lock 68 can then be positioned adjacent cord exit port 66 so that movement of binding cord 64 and straps 48 is more restricted to resist flopping of items in the pouch.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An adjustable pouch comprising:

a nonrigid inner sheet folded in a generally U-shaped arrangement defining a front side and a rear side connected by a bottom portion;

a nonrigid outer sheet secured around an outer surface of said inner sheet;

a plurality of strap receiving channels extending between said inner sheet and said outer sheet on said rear side;

a plurality of non-elastic nonrigid straps extending outward from a perimeter edge of said outer sheet on said front side, wherein said straps are received in said strap receiving channels;

a binding cord interconnecting a distal end portion of each said strap between said inner sheet and said outer sheet;

a first sidewall insert carried by said straps on a first side; and, a second sidewall insert carried by said straps on a second side opposite said first side.

2. An adjustable pouch comprising:

a nonrigid inner sheet folded in a generally U-shaped arrangement defining an inner front section connected to an inner rear section by an inner bottom portion, and defining an open top portion between said inner front section and said inner rear section; wherein said inner front section includes a front outer surface and a front inner surface opposite said front outer surface; and wherein said inner rear section includes a rear inner surface spaced apart from and facing said front inner surface, and a rear outer surface opposite said rear inner surface;

a nonrigid outer sheet having a complementary shape to said inner sheet and folded in a generally U-shaped arrangement defining an outer front section connected to an outer rear section by an outer bottom portion; wherein said outer front section includes a front exterior surface and a front interior surface opposite said front exterior surface; and wherein said outer rear section includes a rear exterior surface, and a rear interior surface opposite said rear exterior surface;

said outer sheet is disposed on said inner sheet so that said front interior surface of said outer sheet is disposed adjacent said front outer surface of said inner sheet, and said rear interior surface of said outer sheet is disposed adjacent said rear outer surface of said inner sheet;

a plurality of strap receiving channels extending horizontally between said rear outer surface of said inner sheet and said rear interior surface of said outer sheet, wherein said strap receiving channels are defined by stitching lines extending at least partially across said outer rear section and bonding said outer sheet to said inner sheet;

a plurality of non-elastic nonrigid straps extending horizontally outward from a perimeter edge of said outer front section of said outer sheet, wherein said plurality of straps include at least two straps extending from a first perimeter edge of said outer sheet and at least two straps extending from a second perimeter edge of said outer sheet opposite said first perimeter edge, and wherein said plurality of straps are received into said strap receiving channels from opposing perimeter edges of said outer rear section and said inner rear section;

a strap loop defined by a looped distal end portion on each of said straps;

a vertical cord channel extending perpendicularly through said plurality of strap receiving channels along a generally central portion between said rear outer surface of said inner sheet and said rear interior surface of said outer sheet;

a binding cord extending through said strap loop of each said strap and through said vertical cord channel between said rear outer surface of said inner sheet and said rear interior surface of said outer sheet; and, a cord exit port disposed in said outer bottom portion of said outer sheet through which said binding cord exits for operation by a user;

whereby drawing and loosening said binding cord causes said straps to move laterally through said strap receiving channels to expand and contract the distance between said front inner surface and rear inner surface.

3. The adjustable pouch of claim 2 including a hook and loop connector material disposed on said front inner surface and said rear inner surface of said inner sheet.

4. The adjustable pouch of claim 3 including a first feed ramp having a complementary portion of hook and loop connector material engaging said hook and loop connector material disposed on said front inner surface, and a second feed ramp having a complementary portion of hook and loop connector material engaging said hook and loop connector material disposed on said rear inner surface.

5. The adjustable pouch of claim 4 wherein said first and second feed ramps each include an angled end portion extending outwardly from said open top portion between said inner front section and said inner rear section.

6. The adjustable pouch of claim 2 including a pair of guide notches disposed in said strap loop on each of said straps, wherein said guide notches receive said binding cord.

7. The adjustable pouch of claim 2 including a first sidewall insert disposed along a first perimeter edge gap between said inner front section and said inner rear section, and a second sidewall insert disposed along a second perimeter edge gap opposite said first perimeter edge gap between said inner front section and said inner rear section.

8. The adjustable pouch of claim 7 including a plurality of sidewall strap channels, wherein each of said straps extends through one of said sidewall strap channels for carrying said first and second sidewall inserts between said inner front section and said inner rear section.

9. The adjustable pouch of claim 8 wherein said first and second sidewall inserts include an angled lip portion extending outwardly from said open top portion.

10. The adjustable pouch of claim 2 including a plurality of molle slots formed in said front exterior surface of said outer sheet.

11. The adjustable pouch of claim 10 wherein said molle slots extend horizontally across said front exterior surface of said outer sheet, wherein said outer front section of said outer sheet is secured to said inner front section of said inner sheet to define two front channels extending vertically between said front interior surface of said outer sheet and said front outer surface of said inner sheet, and wherein said molle slots are arranged to define a first column of vertically spaced molle slots disposed along a first of said front channels and a second column of vertically spaced molle slots disposed along a second of said front channels.

12. The adjustable pouch of claim 10 including a plurality of molle slots formed in said rear exterior surface of said outer sheet.

13. The adjustable pouch of claim 12 wherein said molle slots on said rear exterior surface are arranged in a vertical spaced column along said vertical cord channel.

14. The adjustable pouch of claim 2 wherein said binding cord is arranged in a crisscross pattern extending between said strap loops.

15. The adjustable pouch of claim 2 wherein said binding cord includes a top loop portion extending outward from openings defined between said inner sheet and said outer sheet by stitching lines along a top edge portion of said inner sheet and said outer sheet so that said top loop portion is adjacent said open top portion.

16. The adjustable pouch of claim 2 including a slide lock disposed on said binding cord, wherein said slide lock is adjustable along a length of said binding cord that has exited said cord exit port to control movement of said binding cord through said strap loops.

17. An adjustable pouch comprising:

a nonrigid inner sheet folded in a generally U-shaped arrangement defining a front side and a rear side connected by a bottom portion;

a nonrigid outer sheet secured around an outer surface of said inner sheet;

a plurality of strap receiving channels extending between said inner sheet and said outer sheet on said rear side;

a plurality of non-elastic nonrigid straps extending horizontally outward from a perimeter edge of said outer front section of said outer sheet, wherein said plurality of straps include at least two straps extending from a first perimeter edge of said outer sheet and at least two straps extending from a second perimeter edge of said outer sheet opposite said first perimeter edge, and wherein said plurality of straps comprise elongated generally rectangular arms vertically spaced along said first and second perimeter edges of said outer sheet, and wherein said plurality of straps are received into said strap receiving channels;

a strap loop included on a distal end portion of each of said straps; and, a binding cord extending through said strap loop of each said strap between said inner sheet and said outer sheet.

18. The adjustable pouch of claim 17 a vertical cord channel extending perpendicularly through said plurality of strap receiving channels along a generally central portion between said inner sheet and said outer sheet on said rear side, wherein said binding cord extends through said strap loops in a crisscross arrangement along said vertical cord channel.

19. The adjustable pouch of claim 17 a cord exit port disposed in said outer sheet through which said binding cord exits; a slide lock disposed on said binding cord, wherein said slide lock is adjustable along a length of said binding cord that has exited said cord exit port to control movement of said binding cord through said strap loops.

20. The adjustable pouch of claim 17 including a first sidewall insert carried by said straps on a first side, and a second sidewall insert carried by said straps on a second side opposite said first side; and, a first feed ramp carried by said inner sheet on said front side, and a second feed ramp carried by said inner sheet on said rear side.

* * * * *